United States Patent [19]

Evans et al.

[11] Patent Number: 4,863,082

[45] Date of Patent: Sep. 5, 1989

[54] WATER SKI RACK

[76] Inventors: Andrew L. Evans, P.O. Box 647, Magalia, Calif. 95954; Paul A. Behr, 3881 Benatar, Suite E., Chico, Calif. 95928

[21] Appl. No.: 180,147

[22] Filed: Apr. 11, 1988

[51] Int. Cl.[4] ..... B60R 9/08; B63B 17/00

[52] U.S. Cl. ..... 224/42.45 R; 224/917; 211/70.5; 280/814; 114/364

[58] Field of Search ..... 224/309, 315, 317, 322, 224/323, 324, 326, 325, 329, 42.07, 42.32, 42.33, 42.38, 42.45 R, 42.46 R, 913, 917; 211/70.5, 8; 280/814; 440/104, 109; 114/364, 343

[56] References Cited

U.S. PATENT DOCUMENTS

| | | | |
|---|---|---|---|
| 2,248,170 | 7/1941 | Hansen | 224/42.45 P |
| 4,056,220 | 11/1977 | Trimble | 224/42.45 R |
| 4,238,063 | 12/1980 | O'Dair | 224/917 |
| 4,720,031 | 1/1988 | Zimmerman | 224/917 |
| 4,735,350 | 4/1988 | Kamaya | 224/315 |
| 4,777,900 | 10/1988 | Abeene et al. | 114/343 |

*Primary Examiner*—Henry J. Recla
*Assistant Examiner*—J. Casimer Jacyna

[57] ABSTRACT

A lightweight plastic or metal lockable water ski rack is provided for use in pairs designed to be either removably or permanently attached to a boat. The water ski rack is a two-piece flattened substantially rectangular structure with slots for two water skis and a tow rope. A lower framed panel as a supporting base of each rack is bracketed to the ski boat and a hinged upper framed panel locks down and retains the skis. Ski slots in the lower framed panel are lined with a protective material and slots in the upper panel are fronted with an elastic retainer band. When the upper framed panel is closed down on the lower framed panel with skis in the slots, the elastic retainer band expands into the upper slots and retains the skis in a manner to prevent rattling. Provisions are included for the two closed panels to be locked together by a padlock.

5 Claims, 3 Drawing Sheets

WATER SKI RACK

BACKGROUND OF THE INVENTION

1. Field of the Invention:

This invention relates to ski racks in general and more specifically to a lockable water ski rack designed to be either permanently or removably attachable to a boat.

2. Description of the Prior Art:

The popularity of water skiing has grown over the years and as a consequence, the need for storing and transporting the skis within the boat has developed. The general practice has been to store the skis on the floor of the boat which unfortunately takes up a great deal of the already limited available space. Not only does this practice tend to cause damage to the skis themselves, but the danger of injury to the passengers is always present should the skis be thrown about during an evasive or turbulent movement of the boat.

A search conducted in the classes and subclasses, 211/70.5, 114/343, 364, 224/42.45, and 915, provided the following patents seemed most pertinent to my invention;

Three similar patents, one issued to Shald, Pat. No. 4,232,806, one to Gallant Pat. No. 4,234,112, and the third to Hunter, Pat. No. 4,582,015, illustrate water ski rack attachments for boats. One disadvantage of these particular devices involves the inability to lock the rack to prevent theft. Another drawback is the degree of outward extension of the racks from the boat. On boats having rear outboard motors, the racks would have to be side mounted where the extending sections would prove to be an obstacle to navigation especially when docking.

Pat. No. 4,330,065, issued to Haddad on May 18, 1982, illustrates a portable water ski rack mountable over boat engines. Although this device provides for securing the skis in place, there is no provision for locking the device. Mounting the device is also limited to the area over the boat engine, which may be undesirable in some cases, as with boats having outboard motors.

Several other patents illustrate racks for automobiles and prove to be ineffective for use on boats. The Michael Pat. No. 4,271,997, shows an interior automobile ski rack. Pat. No. 4,372,470 issued to Dallaire and the Kimmel Pat. No. 4,432,480, illustrate automobile roof top racks. Pat. No. 4,469,260 issued to Delahanty, teaches an apparatus for converting automobile roof top surfboard carriers into ski carriers.

Although the past art patent search provided several water ski rack devices, none where found to be in close approximation to our invention. Not only is the design and structure of our device different from the previously mentioned patents, the mounting position is more efficient. Our device also has the option of being lockable and theft resistant. We therefore feel our invention not only overcomes the disadvantages of the past art patents but provides new and useful improvements not previously available in those devices.

SUMMARY OF THE INVENTION

In practicing our invention we have developed a two-piece locking ski rack for boats with mounting fixtures. The rack is designed for two of the racks to be used as pairs and with a pair of racks for retaining one set of water skis.

Therefore, it is a primary object of my invention to provide a water ski rack which secures one set of water skis within a lockable frame in a pair of the racks.

Another object of my invention is to provide a water ski rack which is positionable vertically aligned longitudinally or vertically aligned and horizontally positioned longitudinally.

A further object of my invention is to provide a water ski rack which can be mounted permanently or temporarily to either the transom or the gunwale on the port or starboard side of a boat.

An even further object of my invention is to provide a water ski rack which is compact in size to economize the limited space available on most ski boats.

A still further object of my invention is to provide a water ski rack which is self contained, and requires no additional accessory attachment items such as bungie cords, which can easily be misplaced or lost.

Another object of my invention is to provide a ski rack which protects the edges of the skis within the racks from damage and prevents excessive noise from loose securing means.

Other objects and many other advantages will become apparent with a reading of the following specification and numbered parts list and subsequent comparison with similarly numbered parts shown in the accompanying drawings.

DRAWING REFERENCE NUMBERS

Figure 1:
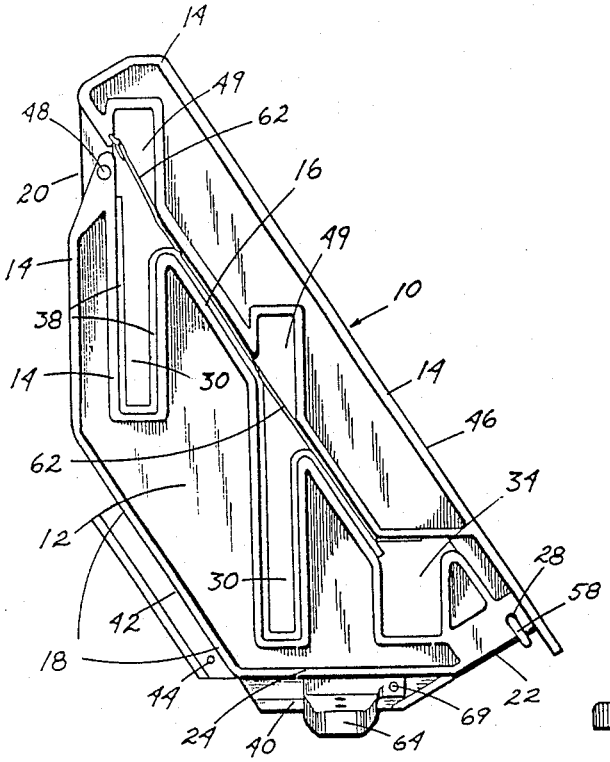
FIG. 1 is a right side view of the first embodiment of the invention in a vertical position.

10 embodiment one
12 supporting base
14 reinforced edging
16 top parallel side
18 bottom parallel side
20 hinged end
22 locking end
24 attachment base
26 lock plate channel
28 lock aperture
30 ski slots
32 skis
34 square rope retainer opening
36 ski rope
38 protective liner
40 vertical retaining ridge
42 horizontal retaining ridge
44 auxiliary lock aperture
46 ski retainer cap
48 hinge
49 retainer ski slots 50 hasp plate
52 lock plate
54 lock plate aperture
56 hook fastener
58 shackle
60 padlock
62 elastic retainer band
64 mounting bracket
66 retaining ridge channel
68 ridge guide extension
69 bracket lock aperture
70 boat
72 bolt apertures
74 C-clamp
76 embodiment two

DESCRIPTION OF THE PREFERRED EMBODIMENTS

Figure 3:
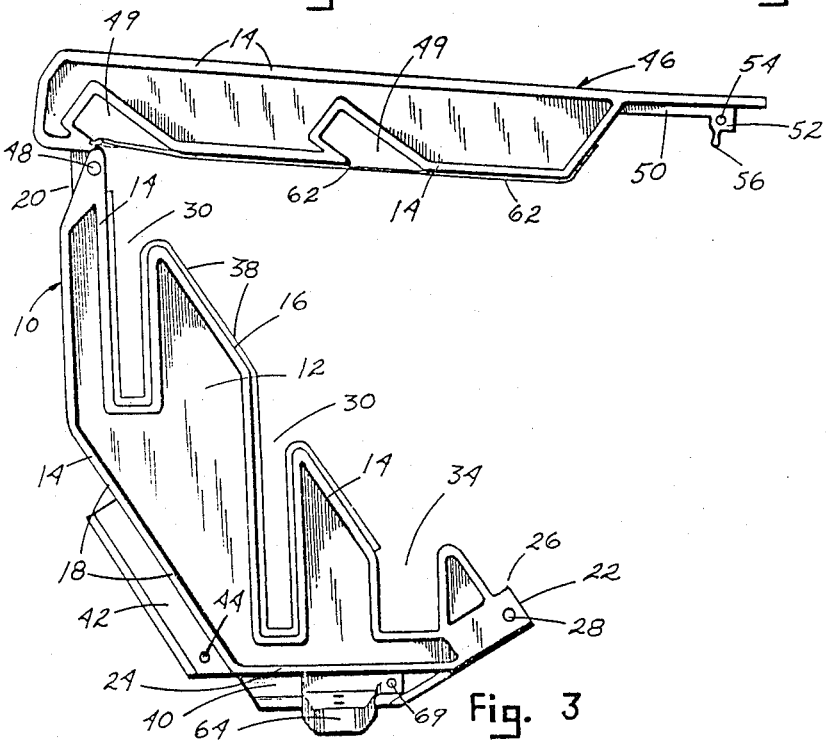
FIG. 3 is a right side view of the water ski rack with the rack in the open position.

Referring now to the drawings and to FIG. 1 where embodiment one 10 is shown in a vertical position. Embodiment one 10 has two framed panels forming a substantially trapezoidal shape with some modifications. Supporting base 12, a framed thin flat, five sided plastic or metal panel is the principal attachment member. The framing, reinforced edging 14, is an overhanging edge encircling the perimeter of support base 12. Reinforced edging 14 serves to provide rigidity to the thin, light weight panel structure of the device. Supporting base 12 is comprised of two parallel sides, best seen in the vertical position as the bottom structure in FIG. 3. A longer upwardly angled side is designated top parallel side 16 and the other is a cut back of the corner at the vertical and horizontal alignment base of a right angle form designated bottom parallel side 18, both of which are pictured in an approximate thirty-two degree angle in FIG. 3. As illustrated in FIG. 1 and FIG. 3, the left upper end of upwardly angled top parallel side 16 peaks with the vertical aligned left upper side of embodiment one 10 at hinged end 20. The opposite end is designated locking end 22. Attachment base 24, the short horizontal bottom section as illustrated, serves as the supporting base for embodiment one 10 for attachment vertically to the gunwale or transom of a boat by mounting bracket 64. The distal end of locking end 22 is slotted with lock plate channel 26. An aperture through the sides of lock plate channel 26 designated lock aperture 28 accepts lock plate 52 and serves as part of the locking system of the device. There are two vertical ski slots 30 projecting down from top parallel side 16, which are sized to each retain one end of one set of skis 32 edgewise. The difference in height of ski slots 30, as seen in FIG. 1, is necessary due to the close proximity of skis 32, to allow sufficient clearance for the fins of skis 32. To the right of ski slots 30 is square rope retainer opening 34, which is designed to hold coiled ski rope 36. Both ski slots 30 are interiorly lined with protective liner 38, which is a thin strip of resilient foam or rubber material designed to protect and secure the edges of skis 32. There are two elongated inverted T-shaped ridges, one located on the outer bottom edge of attachment base 24, designated vertical retaining ridge 40, and one on the outer edge of bottom parallel side 18, designated horizontal retaining ridge 42. Both ridges have one auxiliary lock aperture 44 located on the right distal ends, which serve as a part of the second or auxiliary locking means of the device.

Figure 2:
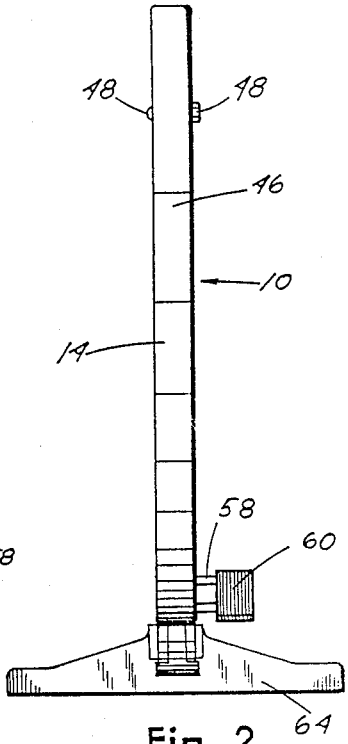
FIG. 2 is a frontal view of FIG. 1.

The second section of embodiment one 10 is framed panel ski retainer cap 46, shown attached to the top right portion of supporting base 12 in the opened position in FIG. 3. Ski retainer cap 46 is a substantially rectangular panel the same thickness as supporting base 12 and is similarly framed by reinforced edging 14, but sized slightly longer in length. Ski retainer cap 46, best shown in FIG. 3 as the top section of embodiment one 10, has two parallel elongated sides, one on top and one on the bottom, a left hinged end and a right locking end. The bottom elongated parallel side has two retainer ski slots 49, shown in FIG. 1 and 2, which correlate in size and align with ski slots 30 when embodiment one 10 is in the closed position. The left end of ski retainer cap 46 is permanently, movably attached to the top section of supporting base 12 by hinge 48. The opposite end of ski retainer cap 46 narrows and forms an outward extension of reinforced edging 14 with a narrow underhanging perpendicular elongated plate called hasp plate 50. The distal end of hasp plate 50 widens and forms lock plate 52, which contains lock plate aperture 54. Lock plate 52 is a rectangular plate having a small projection extending from the bottom edge thereof designated hook fastener 56. Lock plate 52 and hook fastener 56 are sized to be inserted into lock plate channel 26, with hook fastener 56 fitting into a similarly sized channel within lock plate channel 26 as a snap fastener. Lock aperture 28 and lock plate aperture 54 align with one another and serve as the interconnecting locking means to secure skis 32 within embodiment one 10, when shackle 58 of padlock 60 is inserted through the aligned apertures, as seen in FIG. 1 and 2. When embodiment one 10 is not required to be locked, a snap or clip type fastening system is provided in hook fastener 56. When ski retainer cap 46 is in the closed position, for security, shackle 58 of padlock 60 is reinserted through lock aperture 28 and locked. When closure without locking is required, ski retainer cap 46 is brought down into position and hook fastener 56 "snaps" over shackle 58 and retains it in a secured but unlocked position. This prevents ski retainer cap 46 from flying open and skis 32 from rattling or being thrown out. Elastic retainer band 62 is also designed to prevent rattling of skis 32 and secures them in place. Elastic retainer band 62 is an elongated flexible resilient elastic band which is adjustably attached endwardly to the left or hinged end of ski retainer cap 46 and on the right, to the outer surface of reinforced edging 14, as seen in FIG. 1, 3 and 4.

Figure 5:
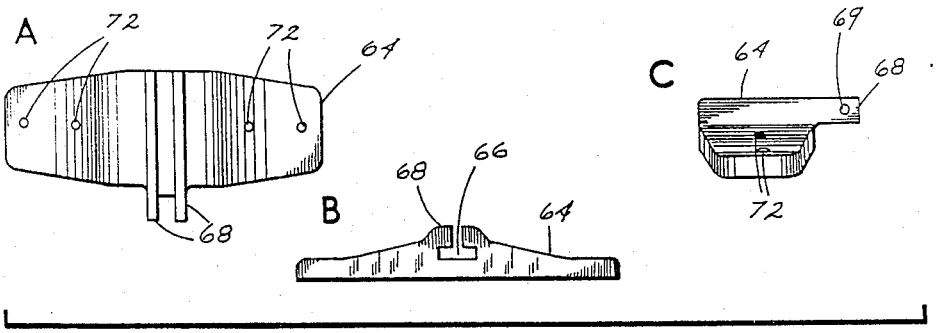
FIG. 5A is a top view of the mounting bracket, B a rear view, and C a right side view.
Figure 6:
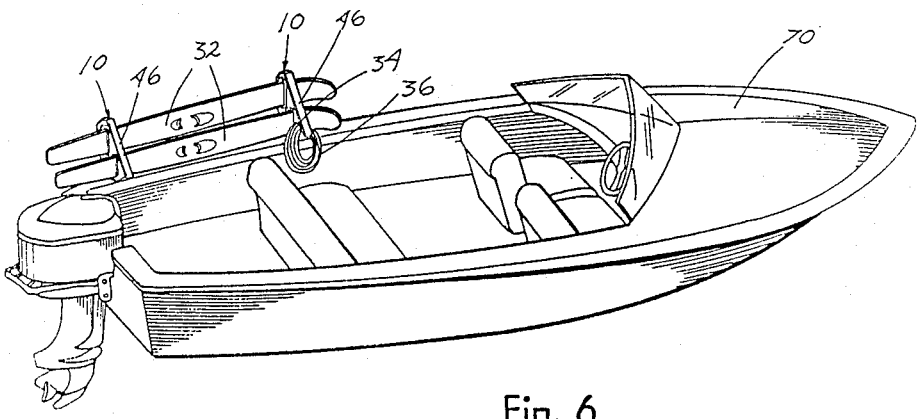
FIG. 6 illustrates the first embodiment in use mounted on the port side of a boat.

Embodiment one 10 is mountable to the gunwale or transom of boat 70 by mounting bracket 64. Mounting bracket 64 is a rectangular plate having two elongated sides, two shorter ends, and a top and a bottom surface, as seen in FIG. 5. The top surface is ridged crosswise and the ridge is entrenched with an inverted T groove designated retaining ridge channel 66. Mounting bracket 64 and retaining ridge channel 66 removably retain and support vertical retaining ridge 40 or horizontal retaining ridge 42. The ridge of retaining ridge channel 66 sits up above the surface of mounting bracket 64 slightly and extends out one side a short distance forming ridge guide extension 68. There is a central aperture through the distal end of ridge guide extension 68 designated auxiliary mounting bracket lock aperture 69, which aligns with auxiliary lock aperture 44 located on supporting base 12 to form an auxiliary locking means The auxiliary locking means is accomplished by the insertion and locking of second padlock 60 through the aligned auxiliary apertures 44. The connection between vertical retaining ridge 40 or horizontal retaining ridge 42 within retaining ridge channel 66 is stable enough to be used without padlock 60 if a more temporary connection is desired.

Figure 9:
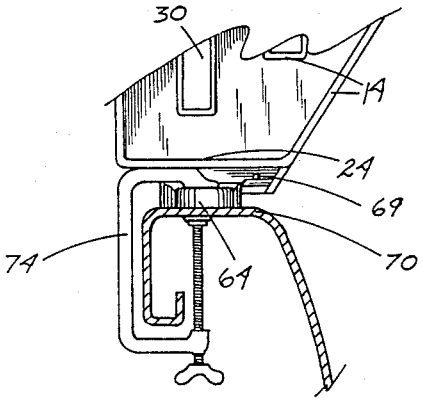
FIG. 9 illustrates the temporary clamping method of attaching the ski rack to the boat.

Attachment of assembled embodiment one 10 to boat 70 can be made permanently with the connection of bolts or screws through bolt apertures 72, which are located two on either side of retaining ridge channel 66 of mounting bracket 64, best seen in FIG. 5, A. Temporary, removable attachment can be made with C-clamp 74. C-clamp 74 serves to fasten mounting bracket 64 against top surface of the side of boat 70, as shown in FIG. 9.

Figure 4:
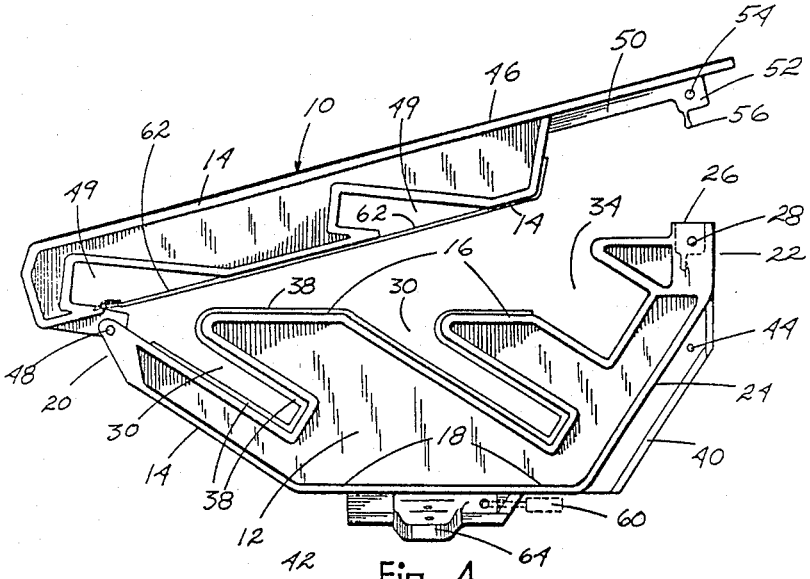
FIG. 4 is a right side view of the first embodiment in the horizontal position.

Embodiment one 10 can be situated vertically inclined but longitudinally in a horizontal position, as seen in FIG. 4, but sliding vertical retaining ridge 40 from within retaining ridge channel 66 on mounting bracket 64, then turning embodiment one 10 counter clockwise and aligning and inserting horizontal retaining ridge 42 within retaining ridge channel 66.

Figure 7:
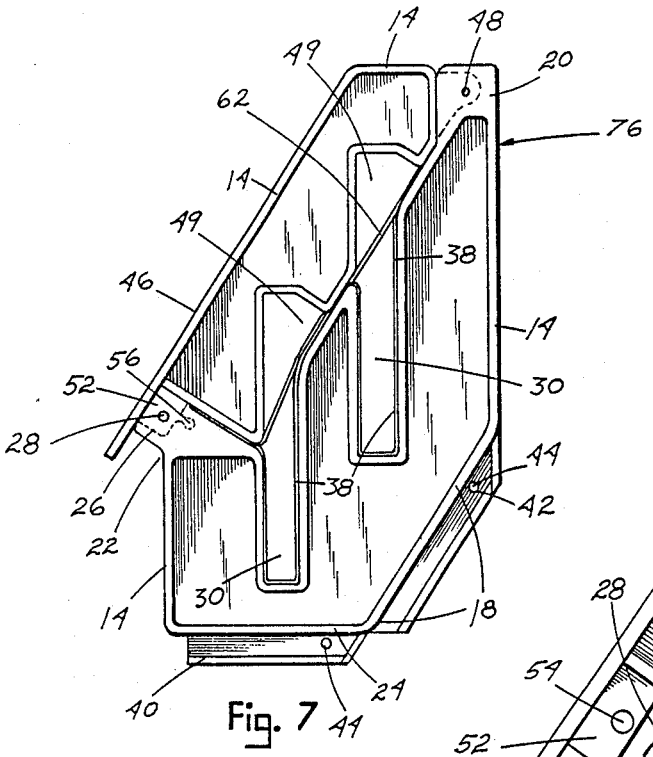
FIG. 7 is a left side view of the second embodiment in the vertical position.
Figure 8:
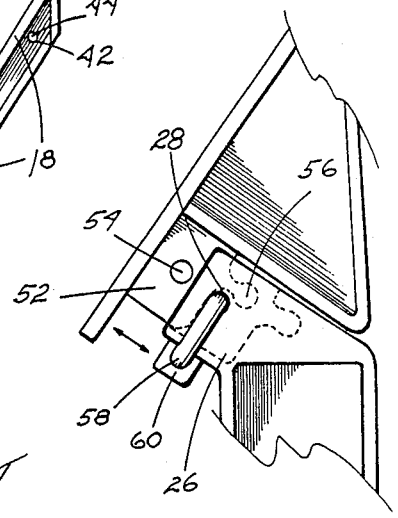
FIG. 8 is an enlargement of the locking mechanism.

Another style of ski rack is provided in embodiment two 76, shown in FIG. 7. All components of embodiment one 10 except for square rope retainer opening 34 are retained.

In use, two mounting brackets 64 are attached either permanently or temporarily to the top edge of the port, starboard or stern section of boat 70. Embodiment one 10 is shown attached to the port side of boat 70, with square rope retainer opening 34 supporting ski rope 36. Retaining ridge channel 66 must be at right angles to the gunwale of boat 70 in order for the ski rack to be positioned properly. Spacing between mounting brackets 64 depends on the length of skis 32. Attachment can be made of embodiment one 10 or embodiment two 76, one to each mounting bracket 64. One set of skis 32 are positioned lengthwise on edge in ski slots 30 of supporting base 12. One ski rack is used to support the rear of skis 32, and a second ski rack is used to support the front. Ski retainer cap 46 is pulled down over skis 32 with elastic retainer band 62 stretching over the edges of skis 32 and locked or secured into position. The removal of skis 32 from either end of the ski racks is prevented by the curve of the front portion of skis 32 and by the fins on the rear portion.

Although we have described our invention in detail in the specification, it is to be understood that modifications may be practiced which do not exceed the intended scope of the appended claims.

What we claim as our invention is:

1. A lockable water ski rack for boats, comprising: two framed panels hingedly attached to each other at first ends thereof, said two framed panels together forming a substantially trapezoidal shaped structure when in side by side relation said structure having two parallel opposite sides and two angular opposite sides oriented at substantially right angles to each other, and said angular sides being oriented at substantially equal angles with respect to said parallel sides, said panels further having inner sides adapted to be adjacent each other when said panels are hinged together, said inner sides being substantially parallel to said parallel opposite sides, there being a pair of substantially rectangular framed slots intersecting said inner sides and extending substantially parallel to one said angular sides and into both framed panels, said slots sized to accept and retain a pair of water skis edgewise; one of said framed panels having a parallel side longer than the parallel side of said other panel whereby said one framed panel is a releasable and retainable cap-like cover for said water skis when placed in said slots, said panels having at a second end thereof means for releasably securing said panels together, said slots being framed and having cushioning line affixed for said water skis, said other framed panel having a framed, opened top downwardly cut square rope-retainer opening adjacent said inner side and said inner side of said one framed panel having affixed thereto along said framing across the openings of said slots an elastic retainer band, there being means for attaching said structure to one of the gunwales and transoms of said boat on said angular side adjacent said releasable securing means and said parallel side of said other panel such that said skis are positionable in one of substantially vertical position and an inclined position with respect to said gunwales and transoms.

2. The lockable water ski rack for boats of claim 1, wherein said water ski racks are multiple operational units requiring two or more racks to support one pair of said skis.

3. The lockable water ski rack for boats of claim 1, wherein said cut square rope retainer opening is sized to lockably retain a coiled rope.

4. The lockable water ski rack of claim 1, wherein said means for attaching said structure to one of the gunwales and transoms of said boats in one of a substantially vertical position and an inclined position with respect to said gunwales and transoms is a removable mounting bracket having a grooved top sized to fit and retain one of two matching edge members which are affixed to said angular side adjacent said releasable securing means and said parallel side of said other panel.

5. The lockable water ski rack of claim 1, where in said means for releasably securing is a snap retainer having locking means associated therewith.

* * * * *